US010762736B2

(12) United States Patent
Collins, Jr. et al.

(10) Patent No.: US 10,762,736 B2
(45) Date of Patent: Sep. 1, 2020

(54) CURRENCY VALIDATION

(71) Applicant: NCR Corporation, Duluth, GA (US)

(72) Inventors: Donald A. Collins, Jr., Buford, GA (US); John Paul Opay, Cebu (PH); Janry C. Amada, Cebu (PH); Peter R. Charpentier, Suwanee, GA (US)

(73) Assignee: NCR Corporation, Atlanta, GA (US)

( * ) Notice: Subject to any disclaimer, the term of this patent is extended or adjusted under 35 U.S.C. 154(b) by 488 days.

(21) Appl. No.: 14/289,811

(22) Filed: May 29, 2014

(65) Prior Publication Data

US 2015/0348350 A1 Dec. 3, 2015

(51) Int. Cl.
*G07D 7/20* (2016.01)
*G07D 7/12* (2016.01)

(52) U.S. Cl.
CPC ..... *G07D 7/20* (2013.01); *G07D 7/12* (2013.01)

(58) Field of Classification Search
CPC ..... G06Q 30/0238; G06Q 30/0225; G06Q 20/3674; G06Q 20/382; G06Q 20/3227; G06Q 20/12; G06Q 20/3223; G06Q 20/20; G06Q 20/0601; G06Q 20/1085; G06Q 20/102; G06Q 20/4016; G06T 2207/10152; G07D 7/12; G07D 7/20; G07D 7/0073; G07D 7/0086; G07D 7/00
See application file for complete search history.

(56) References Cited

U.S. PATENT DOCUMENTS 5,640,463 A 6/1997 Csulits
5,668,377 A * 9/1997 Erickson ..... G07D 7/128 250/461.1
5,727,667 A * 3/1998 Nye ..... G06Q 20/042 194/207
5,790,693 A * 8/1998 Graves ..... B65H 3/063 382/135
5,897,625 A * 4/1999 Gustin ..... G06Q 20/04 109/24.1
5,923,413 A 7/1999 Laskowski
5,942,759 A * 8/1999 Romano ..... G01N 21/6447 250/461.1
6,003,008 A * 12/1999 Postrel ..... G06F 1/183 235/381
6,101,266 A 8/2000 Laskowski et al.
6,405,929 B1 6/2002 Ehrhart et al.
(Continued)

FOREIGN PATENT DOCUMENTS

CN 1241276 A 1/2000
CN 1423800 A 6/2003
(Continued)

OTHER PUBLICATIONS

Translated Version of KR 101244424.*
(Continued)

*Primary Examiner* — Carol Wang
(74) *Attorney, Agent, or Firm* — Schwegman, Lundberg & Woessner

(57) ABSTRACT

Currency is selectively illuminated with Ultraviolet (UV) light, Infrared (IR) light, and/or white light in front of a camera, which may be integrated into a scanner in some embodiments. The camera takes an image of the illuminated currency and the image is presented on a screen of a display for validating the currency.

13 Claims, 8 Drawing Sheets

(56) References Cited

U.S. PATENT DOCUMENTS 6,473,165 B1 10/2002 Coombs et al.
6,550,671 B1 * 4/2003 Brown ..... G07D 11/0066 235/379
6,573,983 B1 * 6/2003 Laskowski ..... G07D 7/20 356/394
6,883,706 B2 * 4/2005 Mastie ..... G06Q 20/1085 235/375
7,006,204 B2 2/2006 Coombs et al.
7,158,662 B2 * 1/2007 Chiles ..... G06Q 40/00 194/206
7,184,133 B2 2/2007 Coombs et al.
7,256,874 B2 * 8/2007 Csulits ..... G07D 7/12 356/71
7,724,938 B2 * 5/2010 Pareskevakos ..... G06K 9/38 382/135
8,086,017 B2 * 12/2011 He ..... G07D 7/20 356/71
2002/0153412 A1 * 10/2002 Numata ..... G07D 7/04 235/375
2002/0163633 A1 * 11/2002 Cohen ..... G01N 21/15 356/36
2003/0169899 A1 * 9/2003 Slepyan ..... G06T 1/005 382/100
2003/0178282 A1 * 9/2003 Bao ..... G07D 7/20 194/328
2004/0188528 A1 * 9/2004 Alasia ..... G07D 7/004 235/468
2004/0222283 A1 * 11/2004 Mastie ..... G06Q 20/1085 235/379
2004/0256196 A1 * 12/2004 Yu ..... G07D 7/128 194/207
2005/0098625 A1 * 5/2005 Walker ..... G06Q 20/209 235/381
2006/0201775 A1 * 9/2006 Tedesco ..... G06Q 20/04 194/206
2008/0037856 A1 * 2/2008 Paraskevakos ..... G06Q 10/00 382/140
2008/0159614 A1 * 7/2008 He ..... G06K 9/6267 382/135
2009/0087077 A1 * 4/2009 Nireki ..... G07D 7/12 382/135
2011/0036682 A1 * 2/2011 Koyano ..... G07D 7/00 194/206
2012/0217416 A1 * 8/2012 Decoux ..... G07D 7/121 250/459.1
2012/0273698 A1 * 11/2012 Gudgell ..... G07D 7/121 250/492.1
2013/0034290 A1 * 2/2013 Lee ..... G07D 7/12 382/135
2013/0044934 A1 * 2/2013 Tolene ..... G07D 7/20 382/135
2014/0152454 A1 * 6/2014 Rabin ..... G08B 5/002 340/815.45
2015/0059086 A1 * 3/2015 Clough ..... G08C 17/02 5/83.1
2015/0287290 A1 * 10/2015 Van Horn ..... G06Q 20/208 705/23

FOREIGN PATENT DOCUMENTS

CN 2704890 Y 6/2005
CN 2872481 Y 2/2007
CN 202142123 U * 2/2012
CN 102592348 A 7/2012
DE 102011121566 A1 6/2013
KR 100813144 B1 * 3/2008
KR 20080078169 A * 8/2008
KR 101244424 B1 * 3/2013

OTHER PUBLICATIONS

Santhanam, Kamesh, Sairam Sekaran, Sriram Vaikundam, and Anbu Mani Kumarasamy. "Counterfeit Currency Detection Technique Using Image Processing, Polarization Principle and Holographic Technique." In Computational Intelligence, Modelling and Simulation (CIMSim), 2013 Fifth International Conference on, pp. 231-235. IEEE, 2013.*
Translated version of CN202142123.*
Translated version of KR20080078169.*
Williams, Marcela M., and Richard G. Anderson. "Currency design in the United States and abroad: counterfeit deterrence and visual accessibility." Review-Federal Reserve Bank of Saint Louis 89, No. 5 (2007): 371.*
Translated Version of KR 100813144.*
Cycleback, David Rudd. Forensic Light: A Beginner's Guide. Hamerweit Books, 2009. https://cycleback.files.wordpress.com/2013/10/forensic-light-guide.pdf.*
Satanovsky, Gary. "Counterfeit Detection: Infrared Scanners, UV Lights & Multi-Testers." Fraud Prevention Blog. Mar. 2, 2011. Accessed Mar. 9, 2018. https://blog.fraudfighter.com/bid/54918/Counterfeit-Detection-Infrared-Scanners-UV-Lights-Multi-Testers.*
Bruna, Arcangelo, Giovanni Farinella, Giuseppe Guarnera, and Sebastiano Battiato. "Forgery detection and value identification of Euro banknotes." Sensors 13, No. 2 (2013): 2515-2529. (Year: 2013).*
Wang, John Zheng. "Digital analysis, comparison, and projection of fingerprints: a new digital device for crime scene investigation." Invest. Sci. J (2011): 3-8. (Year: 2011).*
European Search Report issued in co-pending European patent application EP15164623.9 dated Oct. 14, 2015.

* cited by examiner

A: IR LED – emits 800nm Infrared Light

B: UV LED – emits 375nm Ultraviolet Light

C: LED Boards

D: Controller Board

E: LED Board Interface

F: Microcontroller

F.1: Programming connector

H: USB connection to PC, POS, or Scanner with Camera

CURRENCY VALIDATION

BACKGROUND

Counterfeiting is a major issue in the retail industry. Most enterprises use ad hoc approaches such as using special pens to mark bills or holding the bills up to a light for inspection. Moreover, most enterprises only check bills of high denominations, such as $50, $100 or passports.

Counterfeiters are growing smarter to the techniques and procedures of stores and will pass a larger number of smaller bills that they know are not likely to be checked. The counterfeiters may also only frequent a store once or twice before moving on to pass bad bills at different locations sometimes far away from the initial store where bad bills were passed.

When a store attempts to deposit counterfeit bills with its bank, the counterfeits are discovered resulting in a loss of funds to the store. Counterfeit bills are theft to a store and very costly and such costs are generally passed on to the consumers in terms of higher item prices.

Furthermore, some store clerks may do a poor job of checking for counterfeits during high traffic times at the store. In fact, some times the clerk may not check at all. Diligent clerks that check excessively well may anger loyal customers that are waiting to checkout during high line queue waits. This can cause a store to lose a valuable customer with dissatisfaction.

Therefore, there is a need for more efficient currency validation at a retail checkout.

SUMMARY

In various embodiments, a method for currency validation, a system for currency validation, and a currency validation device are presented.

According to an embodiment, a method for currency validation is provided. Specifically, a currency validation device is directed to illuminate a currency bill placed in proximity to a camera using a selected light source. Next, the camera is instructed to take an image of the illuminated currency bill. Finally, the image is presented in a screen of a display for validation by an operator (e.g., clerk, etc.).

DETAILED DESCRIPTION

Figure 1A:
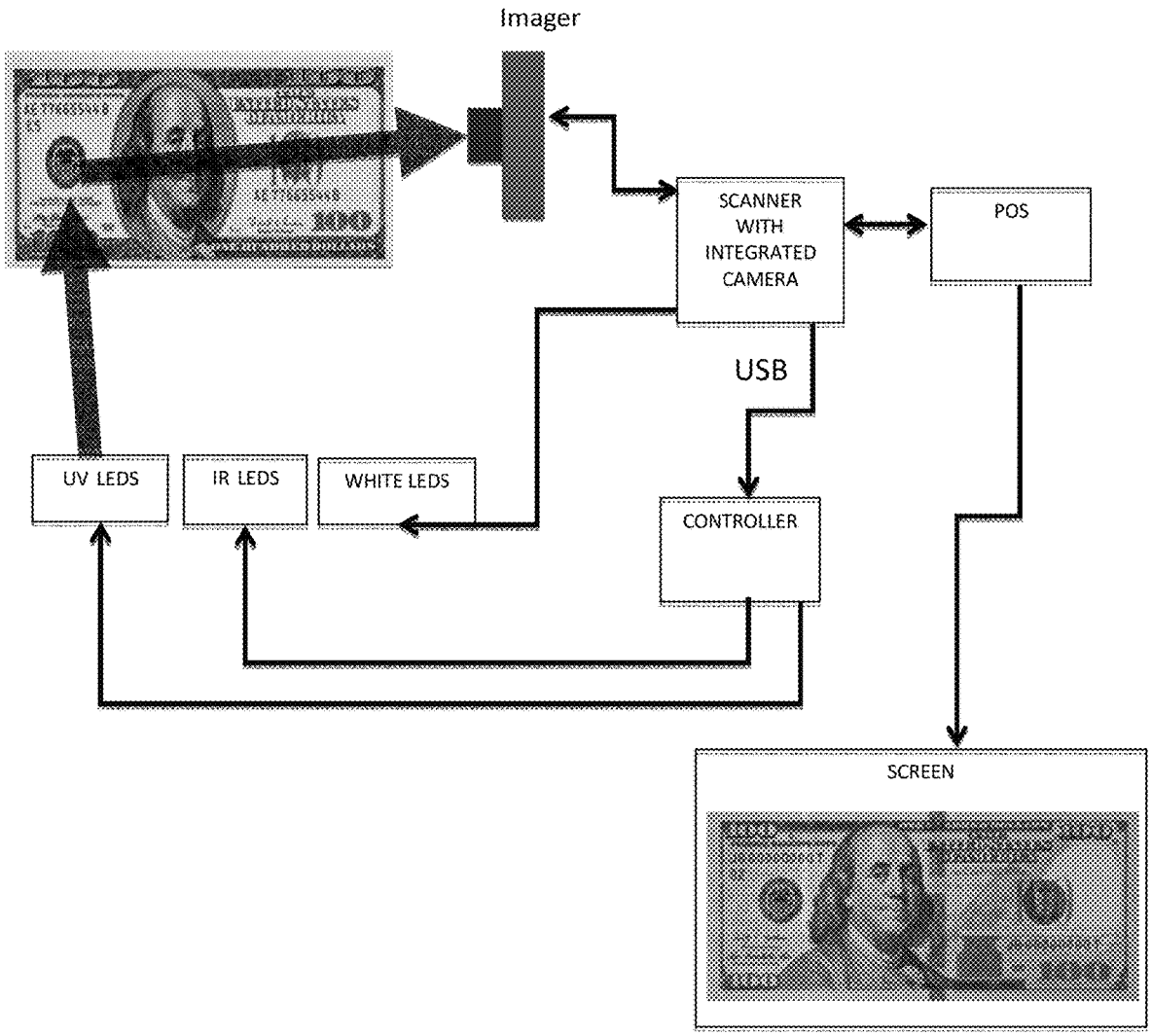
FIG. 1A is a diagram of a currency validation system using Ultraviolet Light (UV), according to an example embodiment.

FIG. 1A is a diagram of a currency validation system using Ultraviolet Light (UV), according to an example embodiment. It is to be noted that the components system are shown in greatly simplified form, which just those components necessary for understanding the embodiments illustrated. Moreover, the layout of the components is presented for purposes of illustration only and is not intended to demonstrate how the components are physically laid out within a checkout station at a retail establishment or other devices, such a Personal Computer. That is, any layout of the components can be achieved without departing from the teachings presented herein.

It is also noted that FIGS. 1A, 1B, 1C, and 1D depict the same currency validation system, which is just performing different operations or being controlled by a different device. So, the features of the single currency validation system depicted in the FIGS. 1A, 1B, 1C, and 1D exists within the single currency validation system as different modes of operation.

The currency validation system of the FIGS. 1A, 1B, 1C, and 1D include a Point-Of-Sale (POS) device (manned by a cashier), a display having a screen, a scanner with a camera (imager), a controller (currency validation device, discussed herein and below), an array of UV LEDs, and array of IR LEDs, and an array of white light LEDs.

The FIG. 1A depicts a situation for currency validation in which a $100 bill is placed in front of the imager (for the scanner) and the scanner (via the USB connection to the controller) instructs the controller to activate the array of UV LEDs to illuminate the front of the $100 bill with UV light. This illumination occurs at approximately 375 nanometers (nm) of UV light. The scanner then activates the imager (camera) of the scanner to capture an image of the UV illuminated $100. The scanner passes the UV illuminated image to the POS device where it is presented to a cashier in a screen of a display associated with the POS device. The UV illuminated image within the screen shows a vertical line to the right of the head of Benjamin Franklin, which was not present in the original image that was not illuminated with the UV light. This characteristic, the vertical bar and its location can be used as proof that the $100 bill is legitimate.

It is noted that different currencies or different denominations of a same country's currency can have different security features exposed based on different types of light illuminated on the currency. So, some currencies may present different features under IR illumination from that what is achieved with UV or white light illumination.

Moreover, it is noted that when a customer hands a bill (currency) to a checkout clerk and the checkout clerk places the bill in front of the imager (camera) to capture the image.

Figure 1B:
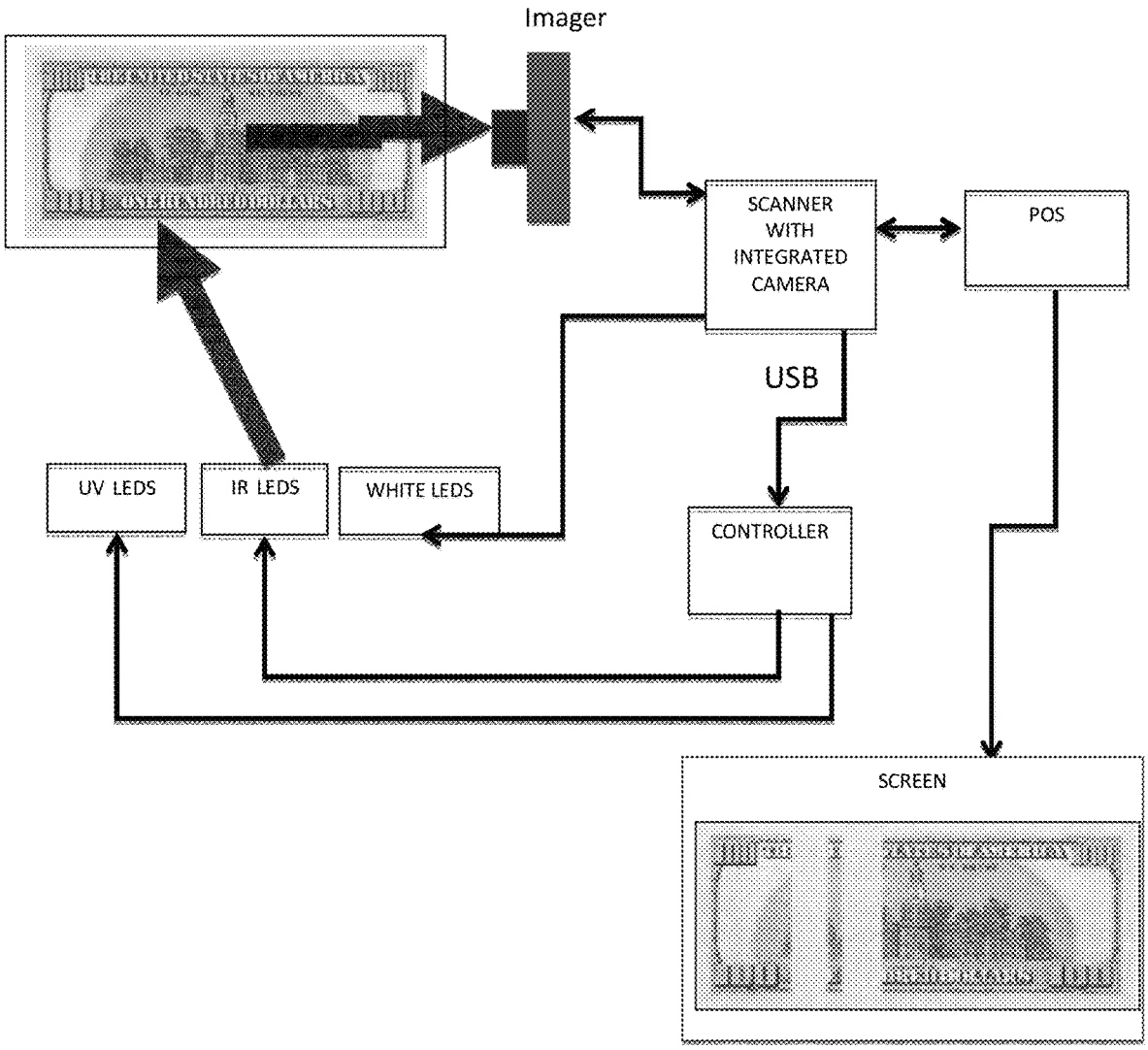
FIG. 1B is a diagram of a currency validation system using Infrared Light (IR), according to an example embodiment.

FIG. 1B is a diagram of a currency validation system using Infrared Light (IR), according to an example embodiment. FIG. 1B differs from FIG. 1A in that the back of a $100 bill is imaged with IR lights based on the direction and control of the controller. This IR illuminated image when presented to the checkout clerk (may also be referred to as a "cashier" herein) within a screen associated with the POS device shows two thick whited out vertical lines, which may be another indication or characteristic that the $100 bill is not counterfeit. The activation of the IR LEDs is done by the controller as directed by the scanner via the USB connection. The $100 bill is illuminated by the IR LEDs at approximately 800 nm of IR light.

Figure 1C:
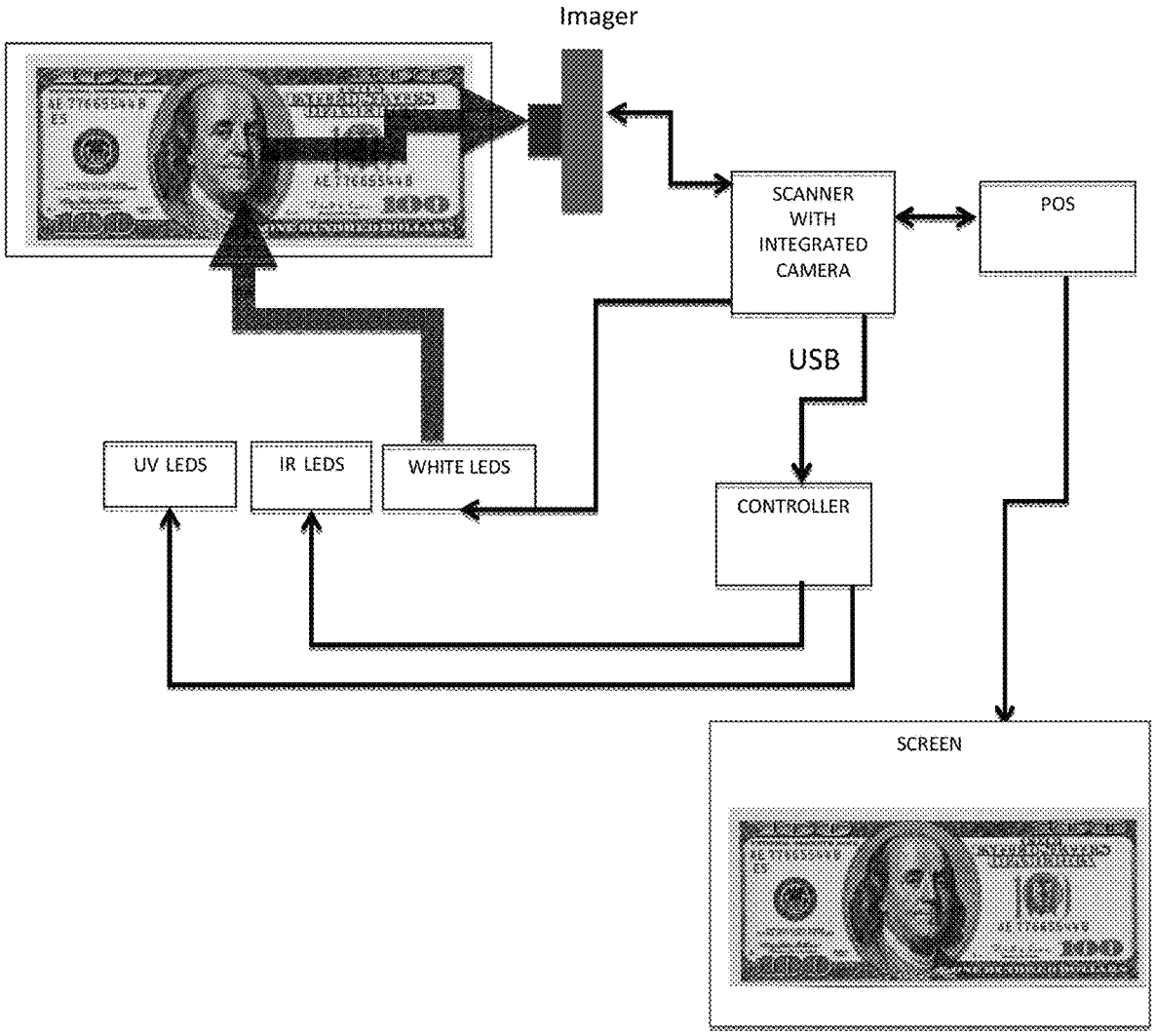
FIG. 1C is a diagram of a currency validation system using white light, according to an example embodiment.

FIG. 1C is a diagram of a currency validation system using white light, according to an example embodiment.

FIG. 1C differs from FIGS. 1A and 1B in that controller illuminates the face of a $100 bill with white light by activating the white LEDs and the scanner to uses the camera (imager) to capture an image of the while light illuminated $100 bill. The image is presented on a screen of a display associated with the POS device for inspection of any known security features that could validate or invalidate the bill.

Figure 1D:
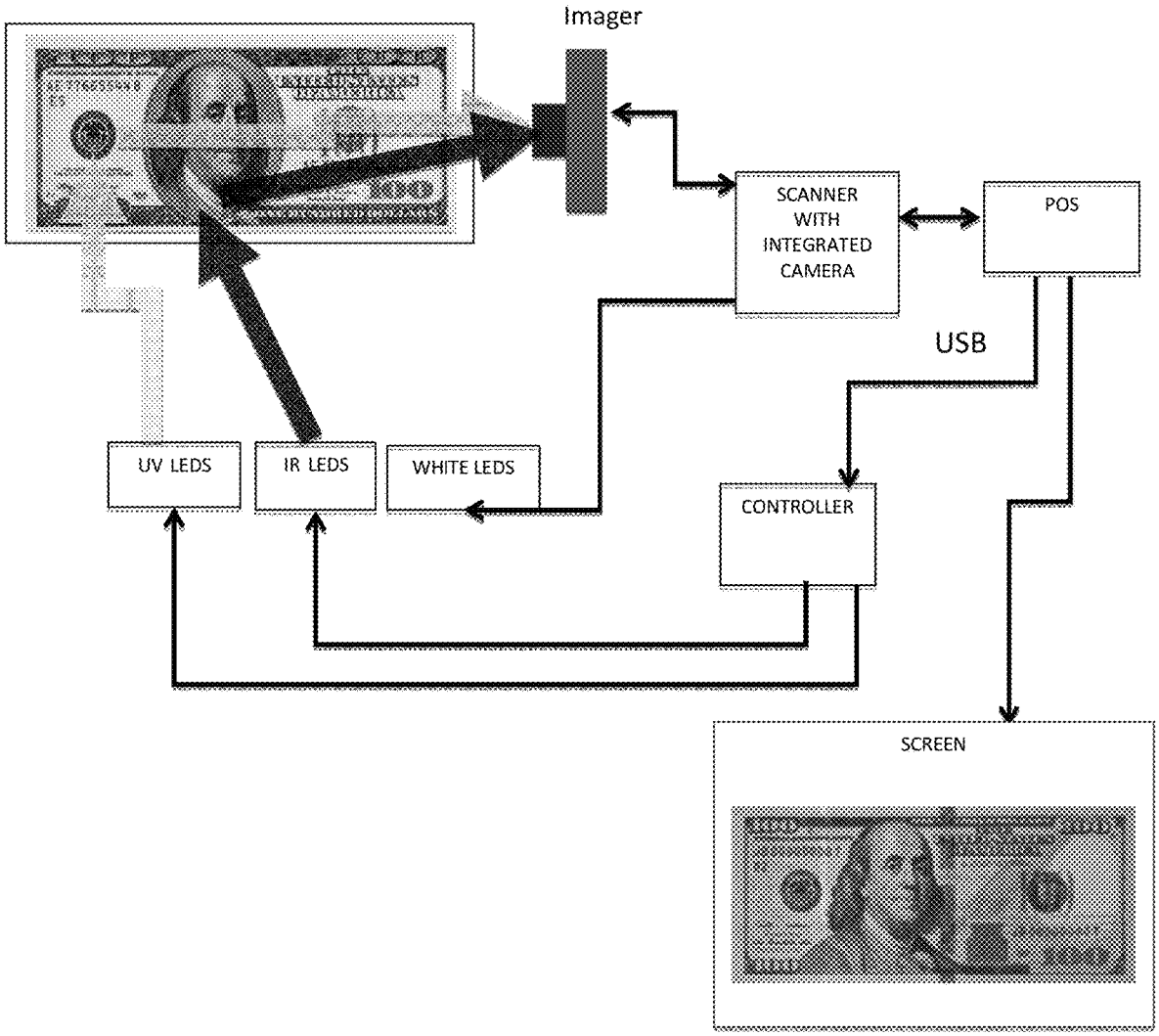
FIG. 1D is a diagram of a currency validation system using both UV and IR lighting, according to an example embodiment.

FIG. 1D is a diagram of a currency validation system using both UV and IR lighting, according to an example embodiment. Moreover, the cashier via the POS device can instruct the controller to perform the illumination using both UV light and IR light. The resulting image presented on a screen of a display for the POS device includes a dark and whited out vertical line, which may be used by the cashier to validate the bill. So, the POS device can send instructions to the controller for selections of UV and/or IR illumination (and/or white illumination if desired). (In the FIGS. 1A-1C it was the scanner that instructed the controller to illuminate the IR, UV, or white lights for imaging of the currency.) The POS device controls the scanner and can activate the imager (camera) that is integrated into the scanner but shown separately in the FIGS. 1A-1D for purposes of comprehension and illustration.

Figure 1E:
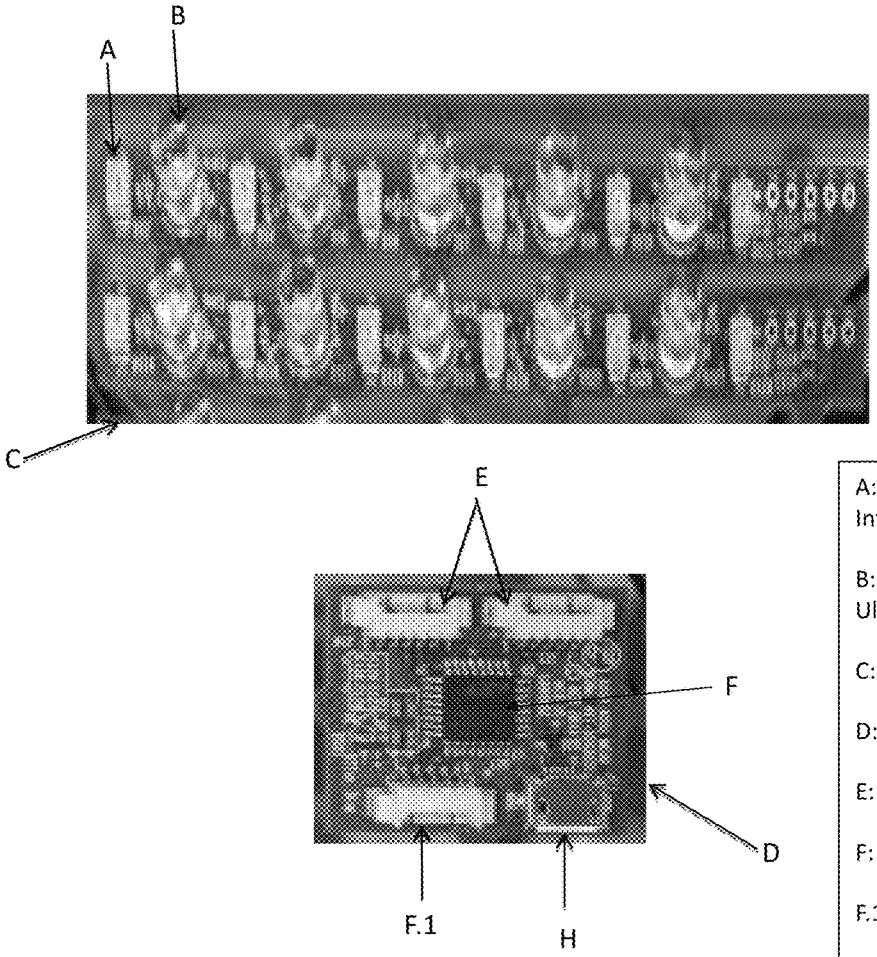
FIG. 1E is a diagram of a currency validation device having a Light Emitting Diode (LED) board and a controller board, according to an example embodiment.

FIG. 1E is a diagram of a currency validation device having a Light Emitting Diode (LED) board and a controller board, according to an example embodiment.

In an embodiment, the currency validation device is the controller and the LED arrays depicted in the FIGS. 1A-1D.

The LED board includes one or more (or an array of IR LEDs) and one or more (or an array of UV LEDs). Although not shown, the LED board may include one or more (or an array of white LEDs).

The LED board is electrically coupled to the controller board. The controller board includes an LED board interface for selectively activating the LEDS on the LED board to illuminate currency placed in front of a camera, the camera taking the image of the currency while illuminated. The controller board also includes a microcontroller or processor having memory and or non-volatile storage. Moreover, the controller includes a programming interface for programming the microcontroller and a device port, such as a USB port.

In an embodiment, the device port is a Bluetooth port.

In an embodiment, the device port is a WiFi port.

In an embodiment, the device port is a cable port.

In an embodiment, the device port is an Ethernet port.

In an embodiment, the device port is a firewire port.

In an embodiment, the controller includes a camera interface for directly interacting with a camera.

The controller can be integrated into any device, such as a Personal Computer, a wearable processing device, a scanner, and the like. The device capable of being interfaced to a camera to image the currency illuminated by the LEDS.

Figure 2:
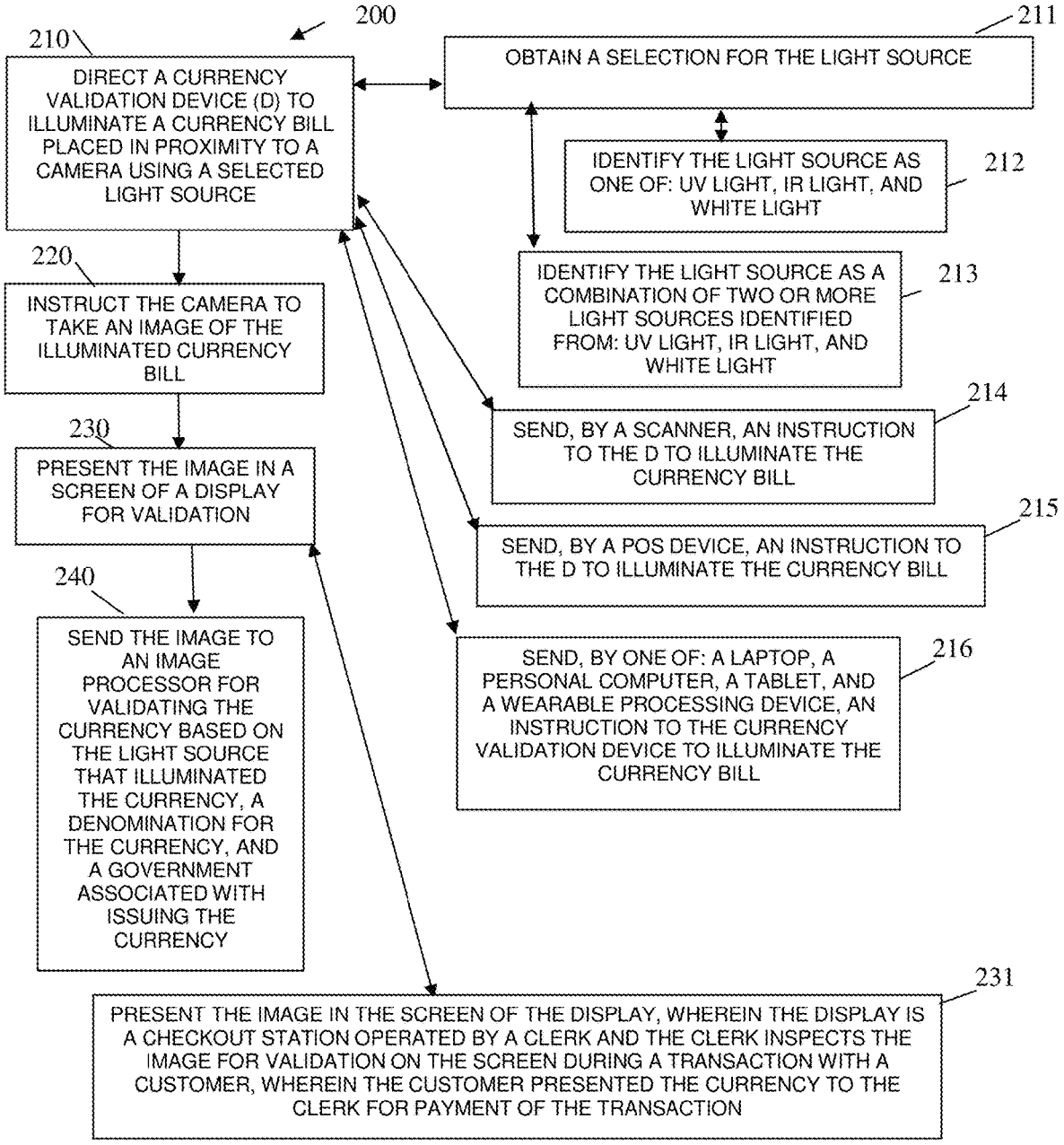
FIG. 2 is a diagram of a method for currency validation, according to an example embodiment.

FIG. 2 is a diagram of a method 200 for currency validation, according to an example embodiment. The method 200 is implemented as one or more software modules as executable instructions that are programmed within memory or non-transitory computer readable storage media and executed by a processing device. The software module(s) are referred to herein as a "currency validator." The currency validator may or may not have access to a network, and any such network may be wired, wireless, or a combination of wired and wireless.

In an embodiment, the currency validator is processed by POS device.

In an embodiment, the currency validator is processed by a scanner.

In an embodiment, the currency validator is processed by a laptop.

In an embodiment, the currency validator is processed by a tablet.

In an embodiment, the currency validator is processed by a desktop computer (PC).

In an embodiment, the currency validator is processed by a wearable processing device.

At 210, the currency validator directs a currency validation device (such as the controller of the FIGS. 1A-1D and the device illustrated in the FIG. 1E) to illuminate a currency bill placed in proximity to a camera. The illumination occurring using one or more selected light sources, each light source a different type (wavelength) of light. In an embodiment the illumination occurs by the validation device at approximately a 45 degree angle directed up at the currency bill.

In an embodiment, at 211, the currency validator obtains a selection for the light source (type of light to use for the illumination).

In an embodiment of 211 and at 212, the currency validator identifies the light source as one of: UV light, IR light, and white light.

In another embodiment of 211 and at 213, the currency validator identifies the light source as a combination of two or more light sources identified from: UV light, IR light, and white light.

In an embodiment, at 214, the currency validator sends, by a scanner, an instruction to the currency validation device to illuminate the currency bill.

In an embodiment, at 215, the currency validator sends, by a POS device, an instruction to the currency validation device to illuminate the currency bill.

In an embodiment, at 216, the currency validator sends, by one of: a laptop, a PC, a tablet, and a wearable processing device, an instruction to the currency validation device to illuminate the currency bill.

At 220, the currency validator instructs the camera to take an image of the illuminated currency bill with the selected light source and type of light.

At 230, the currency validator presents the image in a screen of a display for validation, such as by a clerk operating a checkout station.

For example, at 231, the currency validator present the image in the screen of the display, where the display is a checkout station and the clerk inspects the image for validation on the screen during a transaction with a customer. The customer presented the currency to the clerk for payment of the transaction.

According to an embodiment, at 240, the currency validator sends the image to an image processor for validating the currency based on: the light source that illuminated the currency, a denomination for the currency, and a government associated with issuing the currency.

Figure 3:
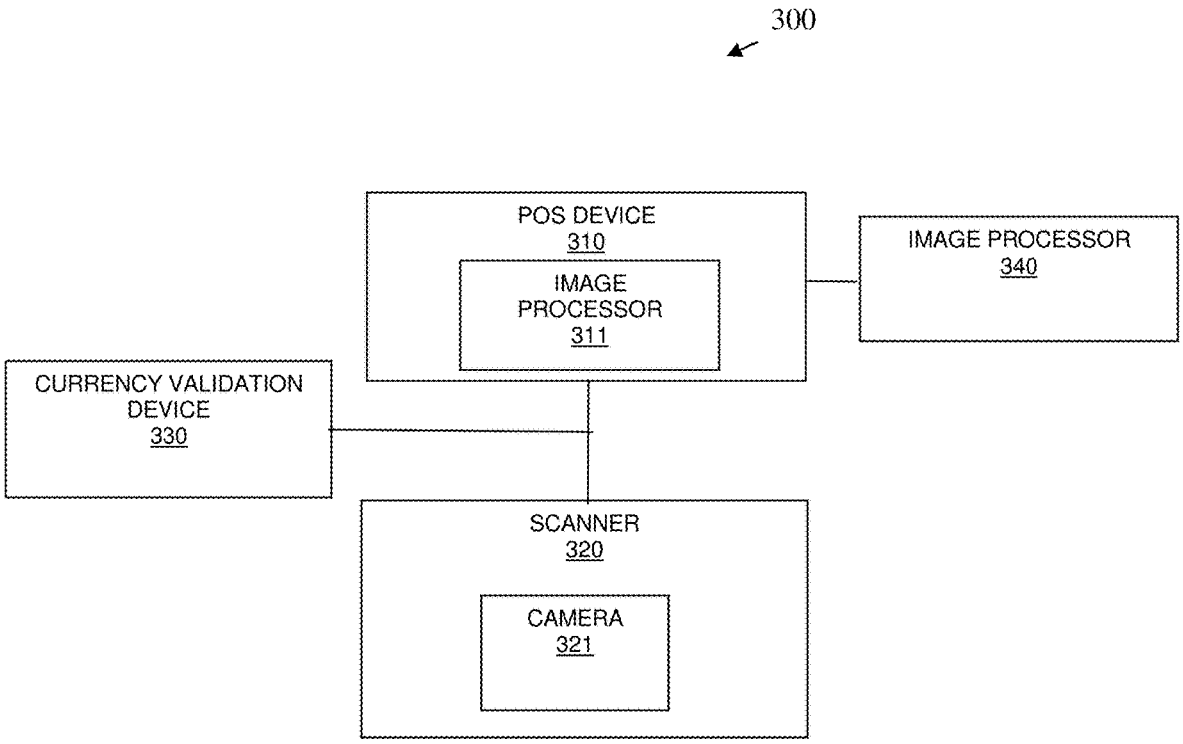
FIG. 3 is a diagram of a currency validation system, according to an example embodiment.

FIG. 3 is a diagram of a currency validation system 300, according to an example embodiment. The currency validation system 300 includes one or more hardware devices and one or more components implemented as one or more software modules as executable instructions that are programmed within memory or non-transitory computer readable storage media and executed by a processing device. The currency validation system 300 may or may not have access to a network, and any such network may be wired, wireless, or a combination of wired and wireless.

The currency validation system 300 includes a POS device 310, a scanner 320, and a currency validation device 330. The POS device 310 may, optionally, include an image processor 311. The scanner 320 includes an integrated camera 321. Optionally, the currency validation system 300 includes a remote and networked image processor 340.

The scanner 320 is interfaced to the POS device 310.

The currency validation device 330 is adapted and configured to: selectively activate different types of light sources to illuminate currency situated in front of the camera or in proximity to a field of view of the camera.

The camera 321 is adapted and configured to image the illuminated currency. The POS device 310 is adapted and configured to present the image within a screen of a display associated with the POS device 310 for currency validation.

In an embodiment, the POS device 310 is adapted and configured to control operation of the currency validation device 330.

In an embodiment, the scanner 320 is adapted and configured to control operation of the currency validation device 330.

In an embodiment, the image processor (311 or 340) is configured and adapted to: recognize attributes in the image based on a type of light source that illuminated the currency when the image was taken, and compare the attributes against predefined attributes to automatically determine whether the currency is valid of counterfeit.

As mentioned above, the image processor 311 may in integrated into the POS device 310 or the image processor 340 may be remotely located over a network from the POS device 310 and interfaced to the POS device 310 over that network.

In an embodiment, the currency validation system 300 is the single currency validation system depicted in the FIGS. 1A-1D.

Figure 4:
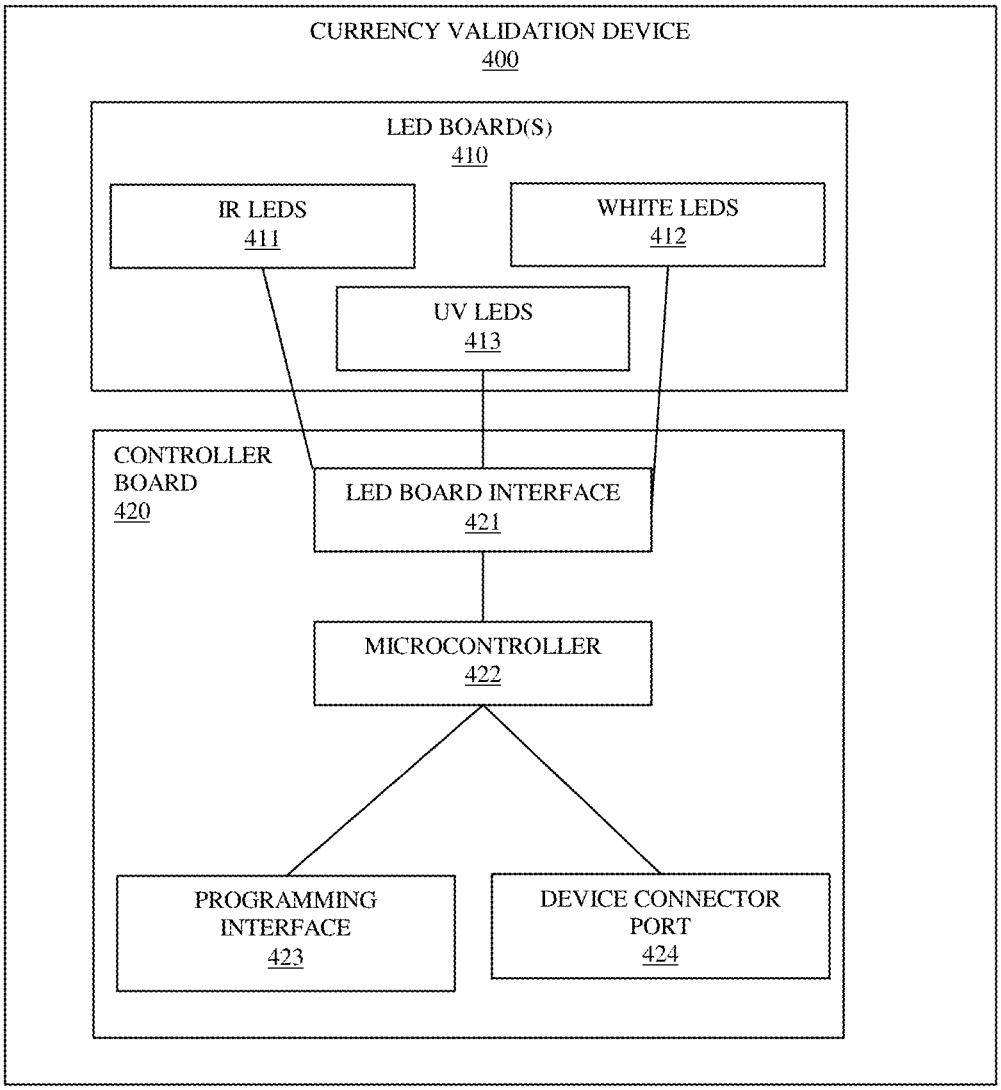
FIG. 4 is a diagram of a currency validation device, according to an example embodiment.

FIG. 4 is a diagram of a currency validation device 400, according to an example embodiment. The currency validation device 400 includes one or more hardware devices and one or more components implemented as one or more software modules as executable instructions that are programmed within memory or non-transitory computer readable storage media and executed by a processing device (microcontroller). The currency validation device 400 may or may not have access to a network, and any such network may be wired, wireless, or a combination of wired and wireless.

In an embodiment, the currency validation device 400 is the controller and LEDs of the FIGS. 1A-1D.

In an embodiment, the currency validation device 400 is the LED boards interfaced to or coupled to the controller board of the FIG. 1E.

The currency validation device 400 includes at least one light board 410 and a controller board 420.

In an embodiment, the currency validation device 400 includes a single LED board having arrays of LEDs for IR 411, white light 412, and UV 413.

The light board 410 includes at least two different types of light, such as IR LEDs 411 and UV LEDs 413.

In an embodiment, multiple light boards 410 exist with each light board 410 having a different type of light.

The controller board 420 includes a light board interface module 421 coupled to the light board 410 and a microcontroller 422 configured and adapted to selectively activate one or more of the at least two different types of light to illuminate the currency that is imaged by a camera.

According to an embodiment, the controller board 420 further includes a programming interface module 423 configured and adapted to interface to a second device to custom program the microcontroller 422.

In an embodiment, the controller board 420 further includes a device connector port configured and adapted to connect to a second device that controls the selective activation of the at least two different types of light.

In an embodiment of the latter embodiment, the second device is one or more of: a camera, a scanner, a POS device, a tablet, a laptop, a wearable processing device, and a phone.

It should be appreciated that where software is described in a particular form (such as a component or module) this is merely to aid understanding and is not intended to limit how software that implements those functions may be architected or structured. For example, modules are illustrated as separate modules, but may be implemented as homogenous code, as individual components, some, but not all of these modules may be combined, or the functions may be implemented in software structured in any other convenient manner.

Furthermore, although the software modules are illustrated as executing on one piece of hardware, the software may be distributed over multiple processors or in any other convenient manner.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A method, comprising:

directing a controller board of a currency validation device to selectively illuminate a currency bill placed in front of a field-of-view of a camera by a cashier at a Point-Of-Sale (POS) terminal during a transaction at the POS terminal by using two selected light sources from a plurality of different types of available light sources, wherein the camera is integrated into a scanner of the POS terminal, wherein directing is responsive to the cashier instructing the controller board to perform illumination on the currency bill using the two selected light sources selected from:

Ultraviolet (UV), Infrared (IR) light, and white light;

instructing the camera to take an image of the illuminated currency bill; and presenting the image in a screen of a display for validation, wherein presenting further includes visually depicting at least one security feature of the currency bill in the image on the display when the currency bill is legitimate where the at least one security feature includes one whited out vertical line and one dark vertical line that were not visible when viewing the currency bill as opposed to the image of the currency bill;

programming a microcontroller of the controller board through a device port of the controller board using a programming interface;

interacting with the camera via a camera interface of the controller board; and processing the method as a currency validation system at the POS terminal during the transaction through interaction between the POS terminal, the camera, and the controller board.

2. The method of claim 1, wherein directing further includes obtaining selections for the two selected light sources from the cashier as a cashier initiated instruction.

3. The method of claim 1, wherein directing further includes sending, by the scanner, an instruction to the controller board to illuminate the currency bill.

4. The method of claim 1, wherein directing further includes sending, by, the POS terminal, an instruction to the controller board to illuminate the currency bill.

5. The method of claim 1, wherein directing further includes sending, by one of:

a laptop, a personal computer, a tablet, and a wearable processing device, an instruction to the controller board to illuminate the currency bill.

6. The method of claim 1, wherein presenting further includes presenting the image in the screen of the display, wherein the display is a checkout station operated by the cashier and the cashier inspects the image for validation on the screen during the transaction with a customer, wherein the customer presented the currency to the cashier for payment of the transaction.

7. The method of claim 1 further comprising, sending the image to an image processor for validating the currency based on the two selected light sources that illuminated the currency, a denomination for the currency, and a government associated with issuing the currency.

8. A system, comprising:

a Point-Of-Sale (POS) device;

a scanner having an integrated camera interfaced to the POS device; and a controller board of a currency validation device adapted and configured to:

i) selectively activate different types of light sources to illuminate currency placed in front of a field-of-view of the camera by a cashier during a transaction at the POS device based on instructions received that identify the different types of light sources received from the cashier operating the POS device, the cashier selecting two of the different types of light sources from: Ultraviolet (UV) light, Infrared (IR) light, and white light;

wherein the camera is adapted and configured to image the illuminated currency, and the POS device is adapted and configured to present the image within a screen of a display associated with the POS device for currency validation, and wherein at least one security feature of the currency is depicted in the image on the display as one whited out vertical line and one dark vertical line when the currency is legitimate where the at least one security feature was not visible when viewing the currency as opposed to the image of the currency;

wherein the controller board including a port configured to:

receive the instructions and program a microcontroller of the controller board through a programming interface;

wherein the system is a currency validation system configured to perform currency validation during the transaction through interactions between the POS device, the scanner, and the controller board;

wherein the controller board includes a camera interface for directly interacting with the camera.

9. The system of claim 8, wherein the POS device is adapted and configured to control operation of the controller board.

10. The system of claim 8, wherein the scanner is adapted and configured to control operation of the controller board.

11. The system of claim 8 further comprising, an image processor configured and adapted to:

i) recognize attributes in the image based on a type of light source that illuminated the currency when the image was taken and ii) compare the attributes against predefined attributes to automatically determine whether the currency is valid or a counterfeit.

12. The system of claim 11, wherein the image processor is integrated into the POS device.

13. The system of claim 11, wherein the image processor is remotely located over a network from the POS device.

* * * * *